US008044232B2

(12) United States Patent
Van De Berg et al.

(10) Patent No.: US 8,044,232 B2
(45) Date of Patent: Oct. 25, 2011

(54) SURFACE-ACTIVE POLYMER AND ITS USE IN A WATER-IN-OIL EMULSION

(75) Inventors: Albert Van De Berg, Kreuzau (DE); Anna Lif, Skärhamn (SE); Ingemar Uneback, Svenshogen (SE)

(73) Assignee: Akzo Nobel N.V., Arnhem (NL)

( * ) Notice: Subject to any disclaimer, the term of this patent is extended or adjusted under 35 U.S.C. 154(b) by 621 days.

(21) Appl. No.: 12/094,200

(22) PCT Filed: Nov. 24, 2006

(86) PCT No.: PCT/EP2006/068873

§ 371 (c)(1),
(2), (4) Date: May 19, 2008

(87) PCT Pub. No.: WO2007/063036

PCT Pub. Date: Jun. 7, 2007

(65) Prior Publication Data

US 2008/0250701 A1 Oct. 16, 2008

Related U.S. Application Data

(60) Provisional application No. 60/779,598, filed on Mar. 6, 2006.

(30) Foreign Application Priority Data

Nov. 29, 2005 (EP) ..... 05111445

(51) Int. Cl.
*C07C 69/66* (2006.01)
*C10M 105/36* (2006.01)
*C10L 1/19* (2006.01)

(52) U.S. Cl. ..... 560/198; 560/200; 508/496; 508/497; 44/301; 44/302

(58) Field of Classification Search ..... 560/1, 176, 560/180, 181, 186; 528/272, 271; 508/465–499; 524/801; 510/289
See application file for complete search history.

(56) References Cited

U.S. PATENT DOCUMENTS

| | | | | |
|---|---|---|---|---|
| 3,876,391 | A | 4/1975 | McCoy et al. | |
| 4,149,983 | A * | 4/1979 | Grier et al. | 508/257 |
| 4,689,166 | A * | 8/1987 | Dohner | 252/75 |
| 4,784,784 | A * | 11/1988 | Dohner | 252/79 |
| 4,820,361 | A | 4/1989 | McKenzie et al. | |
| 5,178,786 | A * | 1/1993 | Jahnke et al. | 252/77 |
| 5,434,323 | A | 7/1995 | Durand et al. | |
| 5,848,644 | A | 12/1998 | Velly et al. | |
| 5,985,804 | A * | 11/1999 | Ashjian et al. | 508/287 |
| 6,516,840 | B1 | 2/2003 | Klug et al. | |
| 6,548,463 | B2 * | 4/2003 | Miyahara et al. | 510/136 |
| 6,733,549 | B2 | 5/2004 | Huffer et al. | |
| 2003/0163947 | A1 | 9/2003 | Rivolta et al. | |
| 2004/0111957 | A1 | 6/2004 | Filippini et al. | |
| 2004/0236064 | A1 * | 11/2004 | Ooga et al. | 528/300 |

FOREIGN PATENT DOCUMENTS

| | | | |
|---|---|---|---|
| DE | 103 21 734 | A1 | 12/2004 |
| EP | 0018085 | A2 | 10/1980 |
| EP | 0 582 507 | B1 | 2/1994 |
| EP | 1 491 561 | A1 | 12/2004 |
| WO | WO 01/51593 | A1 | 7/2001 |
| WO | WO 02/094889 | A2 | 11/2002 |
| WO | WO 03/006588 | A1 | 1/2003 |
| WO | WO 03/031540 | A1 | 4/2003 |
| WO | WO 03/083018 | A1 | 10/2003 |

OTHER PUBLICATIONS

International Search Report for International Application No. PCT/EP2006/068873, May 11, 2007.
European Search Report Application No. EP 05 11 1445, Mar. 16, 2006.
Abstract No. 2005-067212/08 for DE 10321734-A1.
English Translation of Norme NF M07-101, Oct. 2000; Water in diesel fuel emulsion; Determination of stability by centrifugation; Printed by AFNOR on Mar. 26, 2002.
2-Ethyl Hexyl Nitrate (2-EHN); p. 1.
Answer 2 of 2 registry copyright 2004 ASCS on STN.

* cited by examiner

*Primary Examiner* — Ellen McAvoy
*Assistant Examiner* — Pamela H Weiss
(74) *Attorney, Agent, or Firm* — Norris McLaughlin & Norris, PA

(57) ABSTRACT

The present invention relates to a succinic diester polymer which is used in the preparation of water-in-oil macroemulsions. Said polymer, which has an excellent ability to stabilize a water-in-oil macroemulsion, has the formula (I)

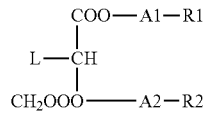

(I)

wherein L is a polyalkenyl group having a number average molecular weight of are poly(alkyleneoxy) chains with a molecular weight of from 500 to 1,200, where each alkyleneoxy group contains 2 or 3 carbon atoms and the number of alkyleneoxy groups being ethyleneoxy groups is at least 50% of the total number of alkyleneoxy groups, and R1 and R2 independently are alkyl groups having of from 1 to 3 carbons atoms. The emulsions of the invention can be used as a diesel fuel, a gasoline fuel, a heating fuel, a dry cleaning liquid, a metalworking fluid or a personal care formulation.

21 Claims, No Drawings

SURFACE-ACTIVE POLYMER AND ITS USE IN A WATER-IN-OIL EMULSION

The present case is based on International patent application No. PCT/EP2006/068873 filed Nov. 24, 2006 and claims priority of European patent application No. 05111445.2 filed on Nov. 29, 2005 and U.S. patent application No. 60/779,598 filed Mar. 6, 2006.

The present invention relates to a surface-active polymer with an excellent ability to stabilise a water-in-oil macro-emulsion. The polymer contains a large hydrocarbon group linked via two ester bonds to two hydrophilic alkyleneoxy chains with a molecular weight of from 500 to 1,200 that are each monoetherified with an alkyl group containing 1-3 carbon atoms. The macroemulsion, hereinafter referred to as emulsion, can be used for instance in cosmetics, dry cleaning preparations, metal working compositions, and fuels for internal combustion engines and for heating.

There is a general desire to be able to prepare a water-in-oil emulsion which is stable for a long period of time. Such an emulsion can be used for example in cosmetic formulations, in dry cleaning preparations, and in metal working compositions. It is also desired to use water-in-oil emulsions as fuels in order to limit the pollution resulting from the combustion of oil. It is well-known that the combustion of oil causes the formation of essential amounts of carbon monoxide, nitrogen oxides, uncombusted parts of the oil, and soot. The addition of a suitable amount of water will reduce this pollution without reducing the combustion yield. The general disadvantage of the existing water-in-oil fuels is that their stability is unsatisfactory and can cause operational disturbances.

The prior art contains a large number of suggestions of how to improve the stability and the homogeneity of water-in-oil emulsions. Some of the art advocates adding a derivative of a polyisobutylene succinic acid (PIBSA) or its anhydride (a PIBSA derivative) as a stabilising and emulsifying agent. For instance, WO 01/51593 describes a water-in-oil emulsion which contains a PIBSA derivative, where said derivative, with one long-chain alkyl via an ester or ether bond, is obtainable by reacting a polyisobutylene succinic anhydride with a polyethylene glycol compound. Further, WO 02/094889 discloses emulsifiers which comprise a half-ester of PIBSA, where the ester group contains at least one group selected from OH, $NH_2$ and/or $NH_3^+$. DE 10321734 also describes a half-ester of PIBSA, but here the ester group is obtained by reacting PIBSA, its anhydride or acid chloride, with a polyglycol mono-(low alkyl)ether. In EP 1491561 an ester compound is also disclosed, which ester is obtained by esterifying a PIBSA compound with a polyol, such as penta(ethylene glycol), pentaerythritol or glycerol.

The derivatives of succinic acid and succinic anhydride have also been used for other purposes than emulsifying water in oil. Thus, EP 0582507 discloses the use of such derivatives as inhibitors for the formation of gas hydrates. The disclosed derivatives are formed by the reaction between a polyalkylene succinic acid, such as PIBSA, or its anhydride, and a mono-ether of polyethylene glycol. The molar proportion between the succinic compound and the glycol is 0.5-2, preferably 1. In the working examples, two half-esters of PIBSA and mono-methyl ethers of polyethylene glycol with a HLB value of 6.6 and 4.9 respectively have been produced.

It has now been found that specific surface-active succinic diester polymers exhibit an unexpected advantageous ability to stabilise aqueous water-in-oil emulsions suitably having a water content of from 2 up to 40 percent by weight. The succinic diester polymer also has a favourable emulsifying effect, which can be further improved by the addition of earlier known emulsifiers. More specifically, the present invention is directed to nonionic surface-active succinic diester polymers having the formula

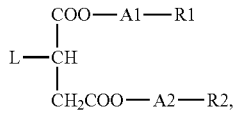

(I)

wherein L is a polyalkenyl group having a number average molecular weight of from 600 to 1,500, A1 and A2 independently are poly(alkyleneoxy) chains with a molecular weight of, on average, from 500 to 1,200, where each alkyleneoxy moiety independently contains 2 or 3 carbon atoms and the number of ethyleneoxy groups is at least 50%, preferably at least 70% of the total number of alkyleneoxy groups, preferably A1 and A2 are poly(ethyleneoxy) chains, and R1 and R2 are alkyl groups having from 1 to 3 carbon atoms, preferably R1 and R2 are methyl groups, and to the use of said nonionic surface-active succinic diester polymers as a stabilising and emulsifying agent in an emulsion of an aqueous phase in a continuous hydrocarbon-containing phase.

The succinic diester polymer may be used in an amount of from 0.10, preferably 0.15, more preferably 0.2, up to 5, preferably up to 3, and most preferably up to 2% by weight of the amount of the final emulsion. The succinic diester polymer provides a good stabilising effect within a large water content range, preferably from 2 to 40% by weight. The succinic diester polymer can have a HLB value in a wide range of 2-16, depending on the composition of the emulsion to be made. Succinic diester polymers with a HLB value of more than 8, preferably more than 8.5, more preferably more than 9, and up to 16, most preferably in the range of 10-16 were found to be particularly suited for a number of water in hydrocarbon emulsions. Preferably, the hydrocarbon is a diesel oil, and if the emulsion is intended for use as a fuel in a diesel engine, then the water content preferably is higher than 5%, more preferably higher than 10% by weight, but preferably lower than 30% by weight, more preferably lower than 25% by weight. Especially for such types of emulsions the HLB of the succinic diester polymers is more than 8, preferably more than 8.5, more preferably more than 9, and up to 16. Most preferably, the HLB is within the range 10-16. In all commercial use of the emulsion the water content has to be adapted to the application conditions.

The succinic diester polymers of formula I can be produced by previously well-known reaction steps. Thus, a polyalkylene compound, such as polyisobutylene, can be reacted for example with maleic anhydride, maleic acid or fumaric acid in order to obtain an intermediate with the formula

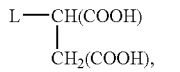

wherein L has the meaning mentioned above, or the corresponding anhydride. Thereafter, the intermediate is esterified with a monoalkyl ether of a polyalkylene glycol of the formula HO-(A1)-R1 and/or HO-(A2)-R2, where A1, A2, R1 and R2 have the meanings mentioned above, at a temperature normally between 100 and 240° C. Preferably, the reaction is performed in the presence of a reaction medium, such as xylene, and/or in the presence of an acid catalyst, such as 4-toluene sulphonic acid, at a temperature of from 100 to 180° C. During the reaction, the condensation water formed in the esterification process is continuously removed. The added amount of the monoalkyl ether of the polyalkylene glycol is about 2 to 2.5 times the molar amount of the intermediate. Preferably, the amount is slightly above 2 moles in order to suppress the content of monoesters that may be formed.

The polyalkenyl group L in formula I may be obtained by polymerising, in a conventional way, one or more olefins until the (co)polymer reaches a number average molecular weight of from 600 to 1,500, preferably from 750 to 1,200. The olefins normally have 2-18 carbon atoms and preferably are alfa-olefins with 2-10 carbon atoms, such as ethylene, propylene, 1-butene, isobutene, 1-hexene, and 1-octene, but also olefins with internal double bonds may be used. It is also possible to copolymerise these olefins with other unsaturated hydrocarbons, such as styrene, and dienes, such as 1,3-butadiene and isoprene.

Independent of how they are used, preferred succinic diester polymers of formula I are those which have HLB values of from 10 to 16, preferably from 11 to 15. These HLB values are calculated using the formula $$HLB=20\times(E+C)/(E+C+H+R1+R2),$$

wherein E is the molecular weight of the ethyleneoxy units, C is the molecular weight of carboxylic groups, H is the molecular weight of the divalent group L-CH—$CH_2$ in formula I, and R1 and R2 are the molecular weight of the groups R1 and R2 in formula I. In the calculation, the presence of propyleneoxy units has been disregarded, since their effect on the HLB value is marginal. Further, R1 and R2 are preferably methyl. It is also preferred that all alkyleneoxy groups are ethyleneoxy groups, as this simplifies the manufacturing process.

The succinic diester polymers of the present invention may be advantageously used as stabilisers and emulsifiers in the manufacture of water-in-oil emulsions where the oil phase contains a hydrocarbon suitable for diesel fuels, gasoline fuels, kerosene, and light or heavy heating oils. In addition to the hydrocarbons the oil phase may also contain vegetable, animal or synthetic oils. An oil in the present application is defined to be a hydrophobic component that is essentially insoluble in water, meaning it has a dissolution of less than 0.1 g per 100 g distilled water at a temperature of 20° C. This component could be either a hydrocarbon/hydrocarbon mixture or an oxygen-containing hydrophobic compound such as a vegetable, animal or synthetic oil, such as a triglyceride; a fatty acid, e.g. a tall oil; or a monoester of a fatty acid, e.g. the methyl or ethyl ester of rape seed fatty acid. The monoester preferably is an ester of a fatty acid having 10 to 22 carbon atoms or mixtures thereof and a monovalent alcohol. The fatty acids can be derived from natural sources, such as coconut oil, corn oil, linseed oil, tallow, tall oil, and rape seed oil, or be produced synthetically. The alcohol preferably is a low-molecular alcohol with 1-4 carbon atoms and most preferably methanol.

The succinic diester polymer of formula I can advantageously be combined with other emulsifying and stabilising compounds. Preferred compounds are nonionic surfactants having a hydrocarbon group or acyl group of 8-22 carbon atoms. The hydrocarbon or acyl group can be derived from naturally occurring fatty acid sources, such as fats or oils of animal or vegetable origin, or it may be synthesised from petrochemicals. In the vast majority of cases the hydrophobic group exists as a mixture of alkyl or acyl chains having different lengths. Especially preferred compounds are those selected from the group consisting of alkoxylated alcohols, alkoxylated amines, amine oxides containing alkyleneoxy groups, alkoxylated esters, alkoxylated acids, alkoxylated amides, and sugar surfactants. Other preferred compounds have the formula $$R^3O—C(O)—R^4—C(O)—N(R^1)—(CH_2)_n—NH—C(O)—R^2 \quad (II)$$

wherein $R^1$ and $R^2$ are independently selected from $C_8$-$C_{22}$ alkyl/alkenyl groups, $R^3$ is a hydrogen or a $C_1$-$C_5$ alkyl group, $R_4$ is a $C_1$-$C_5$ alkylene or alkenylene group, and n is an integer of from 2-5.

Thus, in another embodiment the present invention relates to a mixture which comprises a succinic diester polymer of formula I as defined above and one or more surfactants having a hydrocarbon group or acyl group of 8-22 carbon atoms, which surfactants are selected from the group consisting of alkoxylated alcohols, alkoxylated amines, amine oxides containing alkyleneoxy groups, alkoxylated esters, alkoxylated acids, alkoxylated amides, sugar surfactants and compounds of the formula:

$$R^3O—C(O)—R^4—C(O)—N(R^1)—(CH_2)_n—NH—C(O)—R^2 \quad (II)$$

wherein $R^1$ and $R^2$ are independently selected from $C_8$-$C_{22}$ alkyl/alkenyl groups, $R^3$ is a hydrogen or a $C_1$-$C_5$ alkyl group, $R_4$ is a $C_1$-$C_5$ alkylene or alkenylene group, and n is an integer of from 2-5, with the weight ratio between succinic diester polymer and surfactant being 1:9 to 9:1.

The alkoxylated alcohol or alkoxylated acid can have the formula $R_3O(A_3)_nH$, wherein $R_3$ is a hydrocarbon group or an acyl group with 8-22 carbon atoms, $A_3$ is an ethyleneoxy or a propyleneoxy group, with the proviso that at least 50%, preferably at least 70% of the total number of alkyleneoxy groups is ethyleneoxy groups, and n is a number of from 2 to 15. Preferably, all of the alkyleneoxy groups are ethyleneoxy groups. Specific examples of suitable alkoxylated alcohols are n-octanol, iso-octanol, 2-ethylhexanol, 2-propylheptanol, n-decanol, n-dodecanol, tridecyl alcohol, tetradecanol, stearyl alcohol, oleyl alcohol, and alcohols and mixtures of alcohols derived from natural sources, such as coconut oil, corn oil, linseed oil, tallow, and rape seed oil. Suitable acids for alkoxylation are for example the acids which correspond to the above-mentioned alcohols.

Suitable alkoxylated amines or amides are based on compounds of the formula $R_4(NH—(C_{2-3}\text{-alkylene}))_n\text{-}NH_2$, wherein $R_4$ is an aliphatic group or an acyl group having 8-18 carbon atoms and n is a number of from 0 to 2, which compounds are reacted with 2-12 moles of ethylene oxide or with 3-15 moles of a mixture of ethylene oxide and propylene oxide, with the proviso that at least 50%, preferably at least 70% of the alkyleneoxy groups are ethyleneoxy groups. Preferably, all alkyleneoxy groups are ethyleneoxy groups. Examples of suitable aliphatic groups and acyl groups are n-octyl, isooctyl, 2-ethylhexyl, 2-propyl-heptyl, n-decanyl, n-dodecanyl, tetradecanyl, stearyl, oleyl, and aliphatic groups derived from coconut oil, corn oil, linseed oil, tallow, and rape seed oil as well as the corresponding acyl groups.

Suitable amine oxides are those derived from tertiary amines obtainable by reacting an amine with ethylene oxide or a mixture of ethylene oxide and propylene oxide, with the proviso that at least 50%, preferably at least 70% of the moles of alkylene oxide are ethylene oxide. The starting amine preferably has the formula $R_5(NH—C_{2-3}\text{-alkylene})_n\text{-}NH_2$, wherein n is a number of from 0 to 2 and $R_5$ is an aliphatic or acyl group having 8-18 carbon atoms, with the proviso that when n is 0, then $R_5$ is an alkyl group. The tertiary amine from the alkoxylation step is converted to the corresponding amine oxide by methods well-known in the art.

Suitable alkoxylated esters may be prepared from a monoester of an alcohol and a fatty acid or from a triglyceride ester of fatty acids by reacting them with 1-30 moles, preferably 2-20 moles of ethylene oxide. The monoester preferably is an ester of a fatty acid having 10 to 22 carbon atoms or mixtures thereof and a monovalent alcohol. The fatty acids can for example be derived from natural sources such as coconut oil, corn oil, linseed oil, tallow, tall oil, and rape seed oil, but can also be synthetically produced acids. The alcohol preferably is a low-molecular weight alcohol with 1-4 carbon atoms and most preferably methanol. Typical examples are ethoxylates of a methyl ester of rape seed fatty acids, ethoxylates of castor oil, and ethoxylates of rape seed oil.

Examples of suitable sugar surfactants are alkyl glycosides of the formula RO(G)nH, wherein R is an alkyl group, preferably with 8 to 16 carbon atoms, G is a glycose residue bonded to the alkyl group by a glycosidic bond, and n is a number from 1 to 10, preferably from 1 to 3. Other examples of sugar surfactants are sorbitan esters, such as sorbitan monooleate and sorbitan trioleate.

An example of a compound having formula II is a product resulting from first reacting a fatty acid, e.g. tall oil, with an N-alkyl-1,3-diaminopropane, e.g. N-(tallow alkyl)-1,3-diaminopropane, in a molar ratio of 1:1, followed by reaction of the intermediate with maleic anhydride.

The succinic diester polymer of formula I and its combinations with other stabilising and emulsifying agents may be advantageously used as stabilisers and emulsifiers in water-in-oil emulsions. Accordingly, in another embodiment, the present invention relates to a water-in-oil emulsion which comprises i) 60-95% by weight of an oil phase containing a hydrocarbon
ii) 2-40, preferably 3-35% by weight of water, and
iii) 0.1-5, preferably 0.5-5% by weight of a) a polymer of formula I or b) a mixture comprising a succinic diester polymer of formula I as defined above, and one or more surfactants having a hydrocarbon group or acyl group comprising 8-22 carbon atoms, as defined above; the weight ratio between succinic diester polymer and surfactant being 1:9 to 9:1, up to a total of 100% by weight.

In one embodiment, the oil phase of the emulsion contains a mixture of hydrocarbons having a boiling range from 30° C. to 650° C. Preferably, the oil phase contains a hydrocarbon mixture suitable for use in diesel fuels, gasoline fuels, kerosene, light or heavy oils for heating or a hydrocarbon for metal working, for cold degreasing, for dry cleaning or for personal care applications.

In another embodiment, the hydrocarbon mixture, in which water is emulsified, is a gasoline fuel containing hydrocarbons having a boiling point between 30-215° C., or a diesel fuel with hydrocarbons having a boiling point range of 170-360° C., including Fischer-Tropsch diesel based on fossil or biomass material. In addition to the hydrocarbons the oil phase may also contain vegetable, animal or synthetic oils.

The emulsions of the invention can be prepared by mixing the oil phase and succinic diester polymer, or its mixtures with other surfactants, after which the water and optional additional components are added. The mixture can be emulsified using conventional techniques, such as high-shear stirring. However, if so desired, the sequence of addition of the ingredients may be changed. Advantageously, water is added to the mixture of oil and succinic diester polymer under emulsification conditions.

The emulsion of the invention can advantageously be a diesel fuel, a gasoline fuel, a heating fuel, a metalworking fluid, a cold degreasing fluid, a dry cleaning liquid, and a personal care formulation. Depending on the intended use, the emulsion can also contain a number of complementary conventional components, such as corrosion inhibitors, anti-wear agents, cetane number improvers, anti-freeze, solubilisers, flow regulators, detergents, softeners, antistatic agents, antioxidants, biocides, and colorants or other markers. For example, the emulsion of the invention may contain $C_1$-$C_{10}$ alcohols and ethylene glycols in order to increase the general stability of the emulsion and to serve as an anti-freeze. Particularly suitable compounds are methanol, ethanol, isopropanol, hexanol, 2-ethylhexanol, n-octanol, isooctanol, and monoethylene glycol. Examples of cetane number improvers are organic nitrates, such as 2-ethylhexyl nitrate and ammonium nitrate. Further, the non-ionic nitrogen-containing ethoxylates described above also have softening, biocidal, corrosion inhibiting and/or antistatic effects, but if desired, complementary conventional additives having said effects may be added.

The following examples further illustrate embodiments of the present invention.

EXAMPLE 1

Product

A succinic diester polymer of formula I was produced in the following manner. Polyisobutylene (number average molecular weight of about 910) in an amount of 100 g, maleic anhydride in an amount of 98 g, and xylene in an amount of 20 g were introduced into a reactor. After replacement of the air in the reactor with nitrogen, the temperature was raised to 195° C. and kept there for 24 hours. After removal of maleic anhydride by filtration at 20° C., the yield of polyisobutylene succinic anhydride was determined by anhydride titration to be above 60%, calculated on the conversion of polyisobutylene. The polyisobutylene succinic anhydride obtained from the above reaction was then added to another vessel in an amount of 549 g and further reacted with 494 g of a monomethyl ether of a polyethylene glycol having a molecular weight of about 750, in the presence of 3 g of xylene. The reaction was performed at 220° C. for 8 hours under continuous removal of the water formed during the reaction. Thereupon the temperature was raised to 240° C. and the azeotrope of xylene and water was distilled off at 20 mbar. After cooling to about 100° C. the reaction mixture was filtered under pressure. The reaction mixture obtained contained a succinic polymer of formula I, wherein L represents a polyisobutylenyl group of a number average molecular weight of about 910, R1 and R2 are methyl groups, and A1 and A2 are poly (ethyleneoxy) chains with an average molecular weight of about 750. The HLB value was 12.4. This succinic diester polymer is hereinafter referred to as Succinic Polymer I.

In a similar manner the following succinic diester polymers according to the invention were produced.

Succinic Polymer II. This is a succinic diester polymer in accordance with formula I wherein L represents a polyisobutylenyl group with a number average molecular weight of about 910, R1 and R2 are methyl groups, and A1 and A2 are poly(ethyleneoxy) chains with an average molecular weight of about 1,200. The diester has a HLB value of 14.4.

Succinic Polymer III. This is a succinic diester polymer in accordance with formula I wherein L represent a polyisobutylenyl group with a number average molecular weight of about 910, R1 and R2 are methyl groups, and A1 and A2 are poly(ethyleneoxy) chains with an average molecular weight of about 550. The diester has a HLB value of 11.0.

For use in comparison tests, polymers outside the scope of the present invention were also produced. They were as follows.

Succinic Polymer A. This is a PIBSA derivative outside the scope of the present invention and prepared in accordance with WO 01/51593, Example 1.

Succinic Polymer B. This is a diester outside the scope of the present invention. The diester is similar to Succinic Polymer I of the present invention, but R1 and R2 are dodecyl groups. The diester has a HLB value of 11.1.

Succinic Polymer C. This is a diester similar to Succinic Polymer I, but A1 and A2 are poly(ethyleneoxy) chains with an average molecular weight of 350. The diester has a HLB value of 9.0.

EXAMPLE 2

Four white diesel fuels were prepared by adding a stabilising and emulsifying additive to European diesel having a sulphur content of less than 150 mg/kg (ppm). Two of the fuels were formulated according to the present invention and the additive added contained 30% by weight of Succinic Polymer I, 40% by weight of sorbitan monooleate, and 30% by weight of a $C_{16}$-$C_{18}$ fatty alcohol ethoxylated with 5 moles of ethylene oxide per mole of alcohol. In the other two diesel fuels for comparison purposes, the additive was Succinic Polymer A described in Example 1. The fuels had the following compositions.

TABLE 1

Diesel fuel compositions

| Fuel No. | Additive, 2% by weight | Ethylene glycol, % by weight | 2-ethylhexyl nitrate, % by weight | Water, % by weight | Diesel, % by weight |
|---|---|---|---|---|---|
| 1 | Succinic polymer I/ sorbitan monooleate/ ethoxylate | — | 0.3 | 13 | 84.7 |
| 2 | Succinic polymer I/ sorbitan monooleate/ ethoxylate | 1.3 | 0.3 | 11.7 | 84.7 |

TABLE 1-continued

Diesel fuel compositions

| Fuel No. | Additive, 2% by weight | Ethylene glycol, % by weight | 2-ethylhexyl nitrate, % by weight | Water, % by weight | Diesel, % by weight |
|---|---|---|---|---|---|
| 3 | Succinic Polymer A | — | 0.3 | 13 | 84.7 |
| 4 | " | 1.3 | 0.3 | 11.7 | 84.7 |

The four diesel fuels were subjected to a centrifugation stability test and two sedimentation tests performed at a temperature of 20° C. and 75° C., respectively. The centrifugation was performed according to French Standard NF M07-101. In the sedimentation tests the bottom layer, if any, was measured. The results obtained are shown in Table 2 below.

TABLE 2

Sediments obtained in the centrifugation and sedimentation tests

| Fuel | Centrifugation test, sediment layer, % | | Stability at 20° C., sediment layer, % | | Stability at 75° C., sediment layer, % | | |
|---|---|---|---|---|---|---|---|
| No. | 10 min | 30 min | 3 days | 1 week | 2 days | 4 days | 7 days |
| 1 | 4.2 | 8.4 | 0 | 0 | 1 | 1 | 2 |
| 2 | 4.5 | 9.0 | 0 | 0 | 0.5 | 1 | 2 |
| 3 | 4.8 | 10.8 | 0.5 | 0.5 | 3 | 9 | separated |
| 4 | 6.0 | 14.0 | 0 | 0 | 8 | 10 | separated |

From the results obtained it is evident that the fuels in accordance with the invention are superior to the comparison fuels (No. 3 and No. 4)

EXAMPLE 3

In the same manner as in Example 2, fuel formulations containing 84.7% by weight of Swedish diesel MK 1, 13% by weight of water, 0.3% by weight of 2-ethylhexyl nitrate, and 2% of an emulsifying and stabilising additive as shown in Table 3 below were prepared.

TABLE 3

Emulsifying and stabilising additive used in fuels 5-15. The amounts are calculated as % by weight of the fuel.

| Fuel No. | PIBSA derivative Structure | % | Surfactant 1 Structure | % | Surfactant 2 Structure | % |
|---|---|---|---|---|---|---|
| 5 | Succinic Polymer I, | 0.6 | Sorbitan monooleate, | 0.8 | 2-propylheptanol + 5EO, | 0.6 |
| 6 | Succinic Polymer I, | 0.6 | Sorbitan monooleate, | 0.8 | Oleylamine + 7EO, | 0.6 |
| 7 | Succinic Polymer I, | 0.6 | Sorbitan monooleate, | 0.8 | Oleylmonoethanol-amide + 3EO, | 0.6 |
| 8 | Succinic Polymer I, | 0.6 | Undecanol + 3EO | 1.4 | — | |
| 9 | Succinic Polymer I, | 0.6 | 2-propylheptanol + 5EO, | 0.7 | C16-C18 fatty alcohol + 5EO, | 0.7 |
| 10 | Succinic Polymer III, | 0.6 | 2-propyheptanol + 5EO, | 0.7 | C16-C18 fatty alcohol + 5EO, | 0.7 |
| 11 | Succinic Polymer II, | 0.6 | 2-propylheptanol + 5EO, | 0.7 | C16-C18 fatty alcohol + 5EO, | 0.7 |
| 12 | Succinic Polymer B, | 0.6 | 2-propylheptanol + 5EO, | 0.7 | C16-C18 fatty alcohol + 5EO, | 0.7 |

TABLE 3-continued

| Emulsifying and stabilising additive used in fuels 5-15. The amounts are calculated as % by weight of the fuel. | | | | | | | |
|---|---|---|---|---|---|---|---|
| Fuel No. | PIBSA derivative Structure | % | Surfactant 1 Structure | % | Surfactant 2 Structure | % |
| 13 | Succinic Polymer C, | 0.6 | 2-propylheptanol + 5EO, | 0.7 | C16-C18 fatty alcohol + 5EO, | 0.7 |
| 14 | Succinic Polymer I, | 0.8 | a compound of formula (II), | 0.8 | C13 fatty alcohol + 3EO, | 0.4 |
| 15 | Succinic Polymer I, | 1.2 | a compound of formula (II), | 0.8 | — | |

The compound of formula (II) used in this example is obtained by first reacting tall oil fatty acid with N-(tallow alkyl)-1,3-diaminopropane in a molar ratio of 1:1, followed by reaction of the intermediate with maleic anhydride.

The fuel compositions 5-15 were tested with regard to the sedimentation properties in the same manner as the fuels in Example 1. The results obtained are shown in Table 4 below.

TABLE 4

| Sedimentation tests at 20° C. and 75° C., expressed as % sediment bottom layer | | | | | | | | | |
|---|---|---|---|---|---|---|---|---|---|
| Fuel | Sedimentation at 20° C. | | | | Sedimentation at 75° C. | | | | |
| No. | 3 days, | 1 week, | 2 weeks, | 4 weeks | 2 days, | 3 days, | 4 days, | 7 days, | 14 days |
| 5 | 0 | 0 | 0 | 0 | 0.2 | 0.25 | 0.25 | 0.25 | 0.8 |
| 6 | 0 | 0 | 0 | 0 | 0.1 | 0.25 | 0.3 | 0.3 | 1.3 |
| 7 | 0 | 0 | 0 | 0.5 | — | — | — | — | — |
| 8 | 0 | 0 | 0 | 0 | — | — | — | — | — |
| 9 | 0 | 0 | 0 | 0 | 0.05 | 0.05 | 0.05 | 0.05 | 0.8 |
| 10 | 1 | 1 | 2 | 2 | — | — | — | — | — |
| 11 | 1 | 1 | 2 | 2 | 0.2 | 0.2 | 0.2 | 0.2 | — |
| 12 | 12 | 12 | 13 | 13 | — | — | — | — | — |
| 13 | 13 | 13 | 13 | 14 | 0.8 | 0.8 | 3.5 | 3.5 | — |
| 14 | 0 | 0 | 0 | 0 | <0.05 | <0.05 | <0.05 | <0.05 | <0.05 |
| 15 | 0 | 0 | 0 | 0 | <0.05 | <0.05 | <0.05 | <0.05 | <0.05 |

— = not determined

The results show that the diesel compositions 5-11 and 14-15 formulated in accordance with the present invention have a higher stability towards sedimentation than the comparison formulations 12 and 13 containing PIBSA derivatives.

The invention claimed is:

1. A succinic diester polymer having the formula

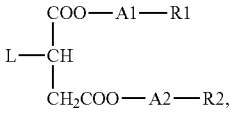

(I)

wherein L is a polyalkenyl group having a number average molecular weight of from 600 to 1,500, A1 and A2 independently are poly(alkyleneoxy) chains with a molecular weight of, on average, from 500 to 1,200, where each alkyleneoxy group contains 2 or 3 carbon atoms and the number of alkyleneoxy groups being ethyleneoxy groups is at least 50% of the total number of alkyleneoxy groups, and R1 and R2 independently are alkyl groups having from 1 to 3 carbon atoms.

2. A succinic diester polymer according to claim 1 wherein A1 and A2 are poly(ethyleneoxy) chains and R1 and R2 are methyl groups.

3. A succinic diester polymer according to claim 1 having a HLB value of more than 8 and up to 16.

4. A mixture comprising a succinic diester polymer according to claim 1 and one or more surfactants having a hydrocarbon group or acyl group of 8-22 carbon atoms, which surfactants are selected from the group consisting of alkoxylated alcohols, alkoxylated amines, amine oxides containing alkyleneoxy groups, alkoxylated esters, alkoxylated acids, alkoxylated amides, sugar surfactants, and compounds of the formula:

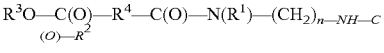

(II)

wherein $R^1$ and $R^2$ are independently selected from $C_8$-$C_{22}$ alkyl/alkenyl groups, $R^3$ is a hydrogen or a $C_1$-$C_5$ alkyl group, $R_4$ is a $C_1$-$C_5$ alkylene or alkenylene group, and n is an integer of from 2-5, with the weight ratio between succinic diester polymer and surfactant being 1:9 to 9:1.

5. A water-in-oil emulsion which comprises i) 60-95% by weight of an oil phase containing a hydrocarbon ii) 2-40% by weight of water, and iii) 0.1-5% by weight of a polymer as defined in claim 1, up to a total of 100% by weight.

6. A water-in-oil emulsion according to claim 5 where the amount of ii) is 335% by weight and the amount of iii) is 0.5-5% by weight.

7. An emulsion according to claim 5 wherein the hydrocarbon is a diesel oil, a gasoline, a kerosene, a light or heavy oil for heating or a hydrocarbon for dry cleaning, for metalworking, for cold degreasing or for personal care applications.

8. An emulsion according to claim 5 wherein in addition to the hydrocarbon the oil phase also contains a vegetable, animal or synthetic oil.

9. An emulsion according to claim 8 wherein the emulsion is a diesel fuel, a gasoline fuel, a heating fuel, a dry cleaning liquid, a metalworking fluid, a cold degreasing fluid or a personal care formulation.

10. A method of stabilizing and/or emulsifying an emulsion comprising a water-containing phase in an amount of 2-40% by weight dispersed in a hydrocarbon-containing phase, which comprises adding to said emulsion an affective amount of the succinic diester polymer of claim 1 in an amount of 0.10 to 5% by weight, where the amounts of water and succinic diester polymer are based on the total weight of the emulsion after the addition.

11. The method of claim 10 wherein the water content of the emulsion is from 2 to 40% by weight.

12. A succinic diester polymer according to claim 2 having a HLB value of more than 8 and up to 16.

13. The mixture of claim 4 wherein in said succinic diester polymer A1 and A2 are poly(ethyleneoxy) chains and R1 and R2 are methyl groups.

14. The mixture of claim 4 wherein said succinic diester polymer has an HLB value of more than 8 and up to 16.

15. A water-in-oil emulsion which comprises i) 60-95% by weight of an oil phase containing a hydrocarbon ii) 2-40% by weight of water, and iii) 0.1-5% by weight of the mixture of claim 4 up to a total of 100% by weight.

16. A water-in-oil emulsion according to claim 15 where the amount of ii) is 3-35% by weight and the amount of iii) is 0.5-5% by weight.

17. An emulsion according to claim 16 wherein the hydrocarbon is a diesel oil, a gasoline, a kerosene, a light or heavy oil for heating or a hydrocarbon for dry cleaning, for metalworking, for cold degreasing or for personal care applications.

18. An emulsion according to claim 15 wherein in that addition to the hydrocarbon the oil phase also contains a vegetable, animal or synthetic oil.

19. An emulsion according to claim 5 wherein the emulsion is a diesel fuel, a gasoline fuel, a heating fuel, a dry cleaning liquid, a metalworking fluid, a cold degreasing fluid or a personal care formulation.

20. A succinic diester polymer according to claim 1 having an HLB value of greater than 11 to 15.

21. A succinic diester polymer according to claim 2 having an HLB value of greater than 11 to 15.

* * * * *